US005992171A

United States Patent [19]

Bacchus

[11] Patent Number: 5,992,171

[45] Date of Patent: Nov. 30, 1999

[54] HEAT EXCHANGER FOR EVAPORATING COOLING REFRIGERATION SYSTEM

[75] Inventor: Rockney D. Bacchus, Santa Teresa, N.Mex.

[73] Assignee: RTI, Inc., Sunland Park, N.Mex.

[21] Appl. No.: 09/086,960

[22] Filed: May 29, 1998

Related U.S. Application Data

[62] Division of application No. 08/756,807, Nov. 26, 1996.

[51] Int. Cl.[6] ..... F25D 5/00; F28D 7/00

[52] U.S. Cl. ..... 62/305; 62/279; 165/162; 165/DIG. 496

[58] Field of Search ..... 62/305, 279, 183; 165/162, 163, DIG. 496

[56] References Cited

U.S. PATENT DOCUMENTS

| | | | |
|---|---|---|---|
| 1,627,713 | 5/1927 | Seymour . | |
| 1,639,172 | 8/1927 | Forcada | 165/DIG. 496 |
| 2,221,530 | 11/1940 | Strang . | |
| 2,919,559 | 9/1960 | Koch . | |
| 3,108,451 | 10/1963 | Clifford . | |
| 3,165,902 | 1/1965 | Paugh . | |
| 3,908,393 | 9/1975 | Eubank . | |
| 3,913,345 | 10/1975 | Goettl . | |
| 3,984,995 | 10/1976 | Starr et al. . | |
| 4,069,687 | 1/1978 | Larriva . | |
| 4,182,131 | 1/1980 | Marshall et al. . | |
| 4,353,219 | 10/1982 | Patrick, Jr. . | |
| 4,477,396 | 10/1984 | Wilkinson . | |
| 4,603,559 | 8/1986 | Wu . | |
| 4,619,317 | 10/1986 | Disselbeck et al. . | |
| 4,909,318 | 3/1990 | Ymse . | |
| 4,939,907 | 7/1990 | Taylor . | |
| 5,048,304 | 9/1991 | Takeuchi . | |
| 5,117,652 | 6/1992 | Takeuchi et al. . | |
| 5,241,829 | 9/1993 | Irie et al. . | |
| 5,337,500 | 8/1994 | Enokizono . | |
| 5,379,832 | 1/1995 | Dempsey . | |
| 5,435,382 | 7/1995 | Carter . | |
| 5,501,269 | 3/1996 | Jenkins . | |

*Primary Examiner*—William Doerrler
*Attorney, Agent, or Firm*—Bacon & Thomas, PLLC

[57] ABSTRACT

An air conditioner operating on a compressor-condenser-evaporator circuit utilizes water cooled by air flowing over an evaporative medium through which the water flows to cool a condenser coil located in a continuous serpentine channel in a sump member located at the lower side of the air conditioner unit. The condenser coils include offset intertwined upright coils that provide a large heat exchange surface with water flowing in the channel to a pump intake region of the sump. A pump is provided to supply the evaporative medium with water from the pump intake region of the sump for continuous circulation through the evaporative medium and the sump channel. A water distributor system supplies water uniformly to the top area of the evaporative medium by creating a film of water that is evenly distributed across the top of the evaporative medium. A raised area of the sump provides access to the interior of the evaporative medium without the need for a water sealing arrangement and a central platform supports the refrigerant compressor, pump and other accessories above the sump channel. The offset relationship of the condenser coils promotes turbulent flow of water that enhances heat exchange between the intertwined coils and the water.

3 Claims, 4 Drawing Sheets

HEAT EXCHANGER FOR EVAPORATING COOLING REFRIGERATION SYSTEM

CROSS REFERENCE TO RELATED APPLICATION

This application is a division of application Ser. No.08/756,807 filed Nov. 26, 1996.

BACKGROUND OF THE INVENTION

A. Field of the Invention

A heat exchanger for an air conditioner refrigeration system using a water heat exchanger with refrigerant condenser coils.

B. Discussion of Related Technology

This invention relates to a heat exchanger adapted for use in a compressor-condenser-evaporator refrigeration system adapted for use in an air conditioning system and more particularly to the compressor-condenser unit of the system. Typical household and commercial air conditioning units utilize a condensable refrigerant that is compressed, condensed, cooled and then supplied to an expansion device and evaporator for cooling air that is circulated through the evaporator in a heat exchange relationship. The compressor and condenser unit typically are located outside the dwelling to be cooled and waste heat from the condenser is exhausted to atmosphere.

The condensers of such refrigeration systems typically are cooled by ambient air or water heat exchanger arrangements. When cooled by water, condenser tubing containing hot refrigerant supplied from the compressor is circulated in heat exchange relationship with water that is circulated over the condenser tubing. The waste heat from the condenser is transferred to the water which is then discharged or recirculated.

It is known in the prior art that to cool the water supplied to condenser coils in such systems adiabatically by circulating the water through an evaporative fill medium and then circulating the water in heat exchange relationship with the condenser tubing. Ambient air is circulated through the evaporative fill medium while the water trickles through the medium to thereby cool the water to a temperature approaching wet-bulb temperature before the water is supplied to the condenser tubing. The water is then recirculated to the evaporative fill medium to effect cooling of the water in the manner just described. Make-up water is supplied to maintain an appropriate level of water in the system. Water heat exchangers are described, for example, in U.S. Pat. Nos. 4,182,131 granted Jan. 8, 1980, and 4,603,559 granted Aug. 5, 1986.

While the water cooled condenser provides efficiencies over the more typical ambient air cooled condenser, inefficiencies still remain with prior art systems, particularly with regard to the heat transfer between the condenser tubing and the water and also with respect to uniform flow of water through the evaporative fill medium during operation of the system. It has been recognized by the applicant that improvement of the heat transfer between the condenser tubing and a water medium can be improved if the water is directed to flow over the condenser tubing in a manner that promotes efficient heat transfer while it is still confined in a relatively compact zone to minimize the overall size of the condenser heat exchanger. Other improvements in water type condenser heat exchangers also have been found to be desirable.

BRIEF SUMMARY OF THE INVENTION

The present invention is concerned with improving heat transfer between hot refrigerant containing condenser tubing and water that has been evaporatively cooled by forming the tubing as coils in a specific intertwined coil arrangement and placing the coils in a channel located in the sump of a compressor-condenser unit, with evaporatively cooled water circulating through the channel. A circulating pump directs water from a pump intake region of the sump to an evaporative fill medium in a highly efficient, uniform manner to cool the water, before it is circulated over the coils.

The sump is preferably formed of a one-piece molded synthetic resin structure having a flat or sloping channel integrally formed in the sump. The sump structure may form the base of a compressor-condenser unit and evaporative fill medium is supported on top of the molded sump structure, for example around the periphery thereof. Water circulated through the evaporative fill medium by a pump located inside the evaporative medium for example, flows downwardly while ambient air is circulated over the fill medium by a fan that is integrally contained within the unit. The cooled water flows downwardly through the evaporative fill medium and in the process is cooled so that it approaches the wet-bulb temperature as it reaches the sump. The cooled water drains into and along the channel by gravity and then flows over the condenser coils to the pump intake region of the sump where the water is picked up by a pump and recirculated to the upper end of the evaporative fill medium.

The condenser coils preferably are uniquely configured as an intertwined pair of helically wound tubes that have been previously bent around a common coiling axis but which have been separated transversely so that the coiling axes of the tubes are offset from each other along the length of the coil with the coil segments intertwined. The offset, intertwined coils present a torturous flow path for the water flowing through the channel that promotes efficient boundary layer heat transfer between the water and the coils.

The offset condenser coil arrangement moreover provides a large heat exchange surface between the tubing of the coils and the water within a relatively compact area within a channel structure.

Water is distributed to the upper end of the evaporative fill medium by the pump, as noted previously, and is distributed to the upper end as a uniform film as opposed to a stream, spray or droplet pattern. A distributor plate associated with a water distributor pipe receives water emitted from apertures in the distributor pipe in the form of a uniform film that flows downwardly over the top area of the evaporative fill medium to thereby distribute the water uniformly over the entire fill medium without dry spots and without excess wet areas.

The sump is constructed such that electrical and refrigerant line access is provided without the need for sealants or water plugs to prevent leakage of water through the access openings. This is accomplished by locating the electrical and refrigerant line access ports above the level of any water circulating through the interior of the unit by molding the sump with the access ports raised above the level of circulating and static water.

Structural efficiencies are furthermore achieved by providing a central mounting platform within the evaporative fill medium and securing the cover with the fan unit to the central platform using a simple bracket arrangement. The central platform supports the compressor as well as the pump and is itself secured to the molded sump structure above the level of circulating water.

DETAILED DESCRIPTIONS OF PREFERRED EMBODIMENTS OF THE INVENTION

Figure 1:
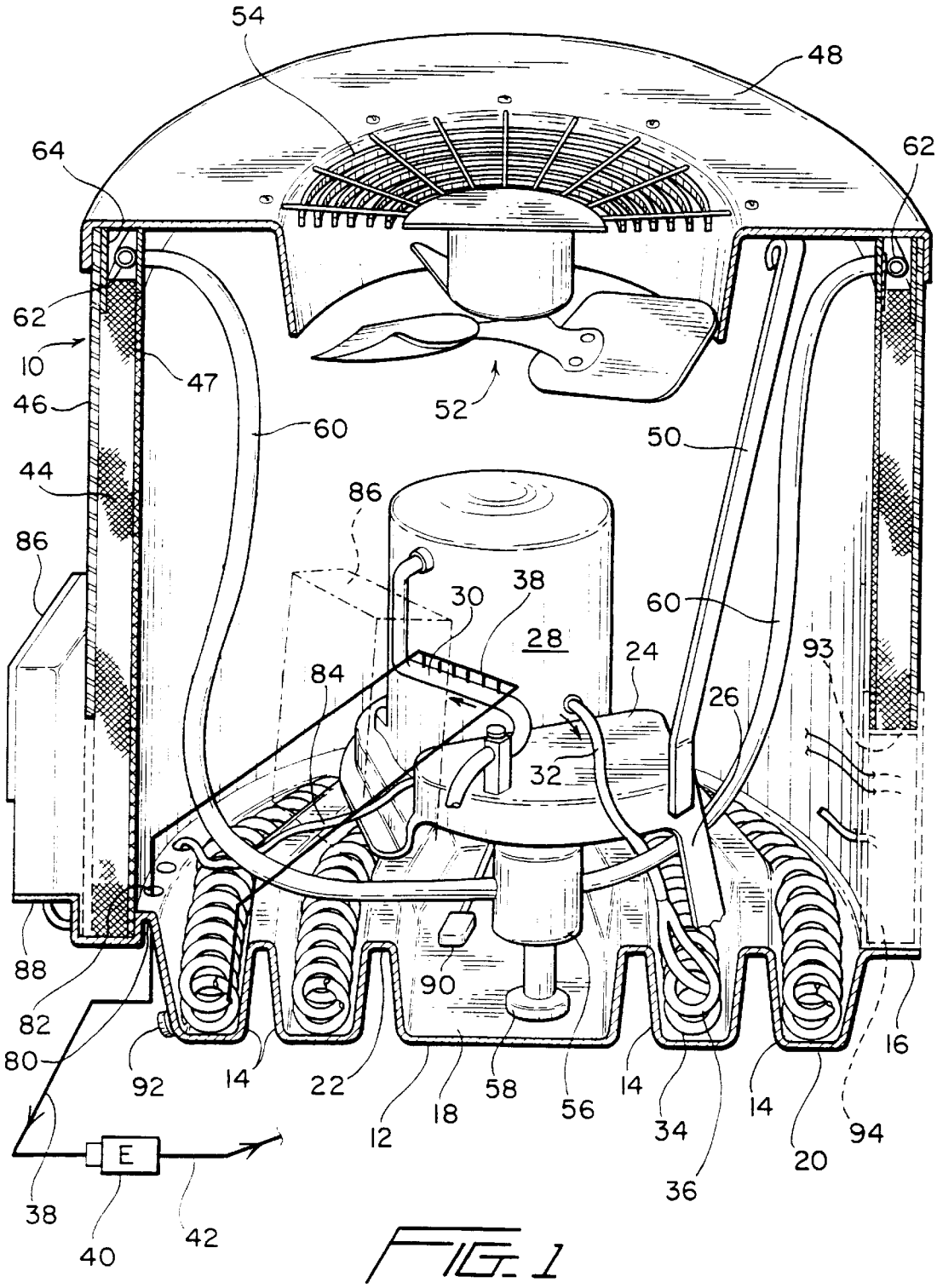
FIG. 1 shows a vertical sectional view of a preferred embodiment of a condenser heat exchanger for an air conditioner system and an associated compressor, water pump, sump, fan and evaporative fill material made in accordance with the invention.

With reference to the drawings, the inventive portion of a high efficiency compressor-condenser unit 10 is illustrated in a sectional view that reveals the details of the compressor and condenser portion of a compressor/condenser/evaporator cooling system using an evaporative fill material to cool a supply of water used in direct heat exchange relationship with a condenser coil of the cooling system.

More specifically, the unit 10 includes a sump 12 preferably formed of a one-piece molded resin material that includes at least one elongated continuous serpentine channel 14, a fill material supporting lip 16 and a central pump intake region which, in the illustrated embodiment, is located centrally within the sump 12. The serpentine channel 14 extends continuously from the fill supporting lip area of the sump inwardly towards the pump intake region 18 of the sump. The bottom of the channel 20 may continuously slope from the fill supporting lip area 16 towards the pump intake region 18, or may be flat, but in either case water entering the channel 14 from the fill supporting lip region 16 will flow gravitationally towards the pump intake region 18 where the pump intake is located after the pump is actuated. If the channel is sloped, a pool will form at the pump intake region 18. The channels 14 are separated by relatively rigid ribs 22 that provide a mounting surface for a central support platform 24 that is bolted or otherwise secured above the ribs 22 by means of platform legs 26 spaced around the support platform 24 and extending between the platform and the top of the ribs 22.

The support platform 24 supports an electrically driven compressor 28 that is charged with a condensable refrigerant (e.g., Freon) in accordance with well-known compressor-condenser-evaporator air conditioning technology, the compressor 28 typically being a sealed unit that is commercially available. Refrigerant inlet line 30 conducts cold gaseous refrigerant to the intake or suction side of compressor 28 while refrigerant outlet line 32 conducts hot compressed refrigerant to condenser tubes 34, 36 located in the channel 14 and which will be discussed in more detail below.

The outlets from condenser coil tubes 34, 36 are merged together and communicate with evaporator inlet or liquid line 38 which supplies the usual expansion device and evaporator system 40 which typically comprises a heat exchanger for cooling air or other medium to be cooled by the cooling system of the invention. The evaporator outlet line 42 communicates with the refrigerant inlet or suction line 30 to return refrigerant to the compressor 28, in accordance with known refrigeration principles. In accordance with this invention, suction line 30 may be placed in heat exchange relationship with condensed refrigerant flowing in line 38 upstream of the evaporator system 40 to supply limited heat to the colder suction line 30 to improve the efficiency of the refrigeration system and to avoid problems associated with the intake of liquid refrigerant in suction line 30 that is undesirably cold or line friction in line 38. Lines 30 and 38 may be disposed in heat exchange relationship by winding one tube around the other or simply by laying one tube against the other in contiguous relationship. The tubes 30, 38 may be overlaid in heat exchange relationship over a length that is suitable to achieve the desired input of heat into the suction line 30 immediately upstream of the intake side of the compressor 28. The tubes 30, 38 may be heated in parallel flow or counterflow relationship, although counterflow is preferred.

The refrigerant circulatory system is, of course, only schematically illustrated and those skilled in the art will understand that the various couplings, fittings and mounting systems have been ignored in this description, although such elements would be provided in any actual air conditioning system.

An evaporative fill material 44 typically secured to an outer grill element 46 is mounted on the upper surface of the fill supporting lip 16 and extends upwardly above the lip 16, as illustrated. The evaporative fill material 44 may be any well-known material used in evaporative air conditioning systems or other systems used to cool water by circulating air over a continuously moistened fill medium. Such fill materials are known to those skilled in the art and, for example, may be made of a fiberglass matte material or similar substance. The grill 46 preferably is an open mesh grill having upwardly inclined grill elements that tend to retain water flowing through the fill material 44. A vertically rigid yet bendable backing 47 with apertures supports the fill material 44 and grill 46 in a vertical orientation.

A cover 48 tied down over backing 47 by brackets 50 that may be anchored to platform 24 or to the ribs 22 is mounted above the fill 44, grill 46 and backing 47 and retains the upper annular end of the fill and grill as a backing in its position as shown in FIG. 1. An air circulating fan 52 is supported by the cover 48 and is provided with electrical power through appropriate electrical leads (not illustrated) under the control of a central control system.

The fan 52, when actuated, draws air in through the grill, fill and backing and inwardly through the impellers of the fan 52 and then outwardly through the upper grill 54 for discharge into the surrounding atmosphere.

The sump 12 is initially charged with a water cooling medium that forms a layer or pool of water in the sump. The volume of water provided in sump 12 will be adequate to provide sufficient water to soak the fill material 44 and to continuously circulate water from the sump 12 to the fill medium 44 during operation of the system. A suitable water make-up conduit (not shown) supplies water lost to evaporation. Preferably, the condenser coils formed by tubes 34,36 will be totally submerged within the channel 14 to minimize corrosion problems associated with exposure of the tubes (usually copper) to oxygen in air.

A pump 56 having an intake port 58 at the bottom of sump 18 is normally electrically actuated by electricity supplied through electrical lead lines (not shown) to cause pumping of water from the sump 18 upwardly through conduits 60 into water distributor pipes 62 located above fill medium 44. A plurality of water distributor pipes 62 and conduits 60 are preferred to provide even distribution of water supplied from pump 56 throughout the upper region of the fill medium 44. For example, two pipes 62 may be used in a typical application, but more pipes and water supply lines 60 can be provided as needed.

Figure 8:
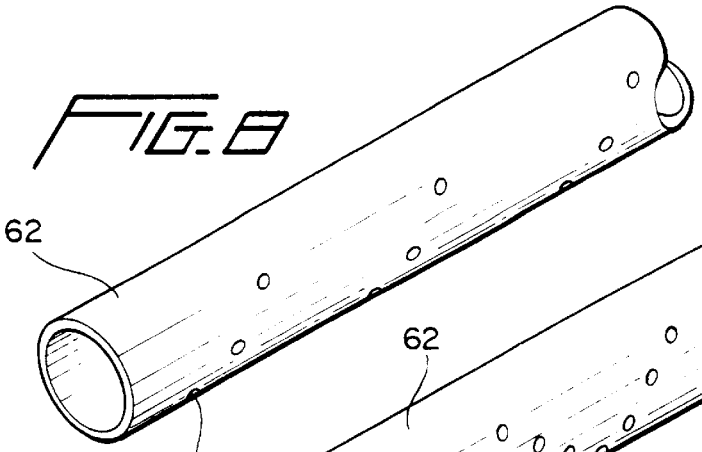
FIGS. 8, 9 and 10 show various embodiments of a water distributor pipe made in accordance with the invention.
Figure 9:
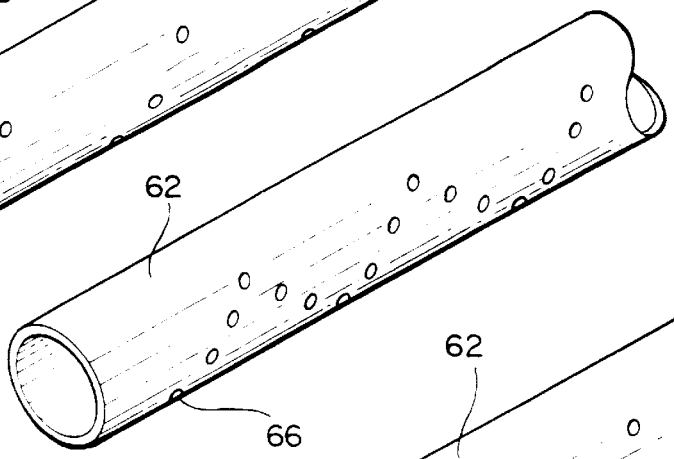
Figure 10:
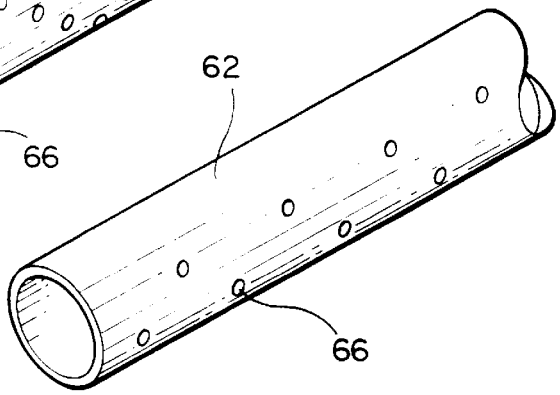
Figure 7:
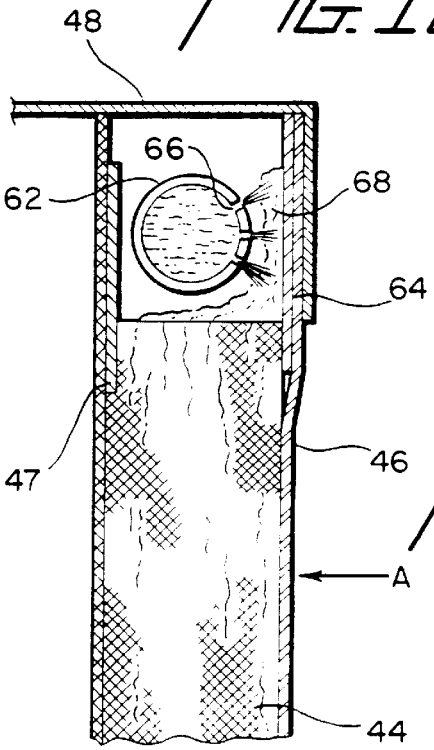
FIG. 7 is a vertical sectional view showing a detail of the water distribution system above the evaporative fill material in the heat exchanger.
Figure 11:
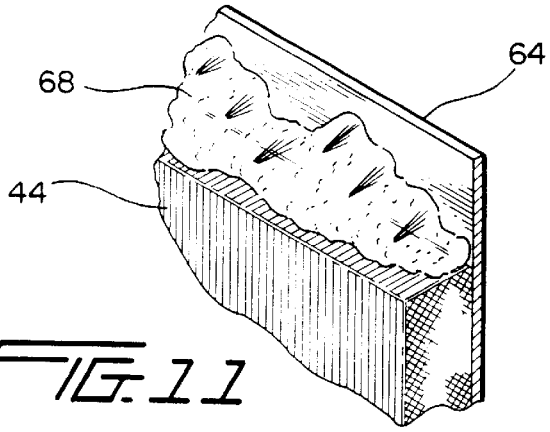
FIG. 11 is a schematic illustration of the distribution of a water film applied to a water distributor plate associated with the evaporative fill material in accordance with the invention.
Figure 12:
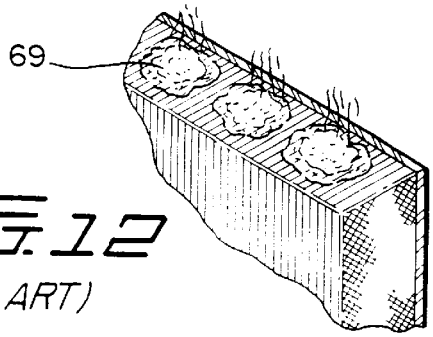
FIG. 12 (PRIOR ART)
FIG. 12 shows an example of water distributed in accordance with a prior art water distributor.

A detailed view of the water distributor pipe 62 and its relationship with the fill medium 44 and plate 64 is illustrated in FIG. 7, while FIGS. 8, 9 and 10 illustrate various preferred configurations of water outlet openings in the distributor pipes 62. More specifically, a generally vertical distributor plate 64 is located on the air inlet side of fill 44 so as to extend above the fill material 44 closely adjacent the water distributor pipe. Water distributor pipe 62 is provided with an array of water outlet apertures 66 that may be distributed along one side of the water distributor pipe 62 so as to discharge water against the distributor plate 64 as a continuous film 68, without streaming down or splashing, as shown schematically in FIG. 11. Unlike prior art water distribution arrangements which distribute water in separated streams or spray patterns that reach a fill medium as isolated pools or streams 69, as illustrated, for example, in FIG. 12, the water distribution pattern discharged from water distributor pipe 62 impacts gently against the distributor plate 64 uniformly across the peripheral length of the distributor plate so that an even, continuously flowing film of water 68 reaches the top of the fill medium 44 during operation of the pump 56. This ensures uniform continuous distribution of water along the top of the fill medium 44 to thereby evenly distribute water throughout the fill medium in a uniform manner with the air moving across the fill medium in the direction of arrow A.

In accordance with well-known evaporative cooling principles, circulation of air across and through the moistened fill medium 44 by means of fan 52 will cause cooling of the air, for example, as explained in U.S. Pat. No. 4,182,131.

As illustrated in FIGS. 8–10, the array of water outlet openings 66 preferably is distributed over the length of the water distributor pipe such that the outlets are spaced longitudinally and vertically from each other along the length of the pipe. Different opening arrays are illustrated as exemplary and it should be understood that any appropriate array may be utilized that will ensure a continuous film of water 68 being formed on distributor plate 64 for ultimate flow uniform flow across the top of the film medium 44.

The apertures 66 are suitable dimensioned to avoid clogging by contaminants that may be contained in the flowing water. For example, the apertures should not be less than approximately ⅛" (3.175 mm) and should be spaced typically approximately ½" (12.7 mm) apart in several tiers or elevations to accommodate various levels of water flowing in the pipe 62. For example, at low water volume, the water will flow out the lowermost apertures provided in the pipe 62 while at higher volumes of water, the higher apertures will discharge water, etc. The spacing of the apertures is selected to ensure an even distribution of water on distributor plate 64 and flowing downwardly uniformly as a film across the upper edge of the evaporative medium 44. This avoids flooding of some areas of the evaporative medium while avoiding drying out of other areas of the medium.

Water typically has a cohesive nature which tends to draw it into a stream when it is sprayed against a hydrophobic material, but this becomes less critical if the impingement material is hydrophilic. In either case, the evaporative fill material should be in contact with the distributor plate 64 so that the water will transfer to the evaporative fill as a film and will not form into droplets or isolated streams before transferring from the distributor plate 64 to the fill medium.

Figure 2:
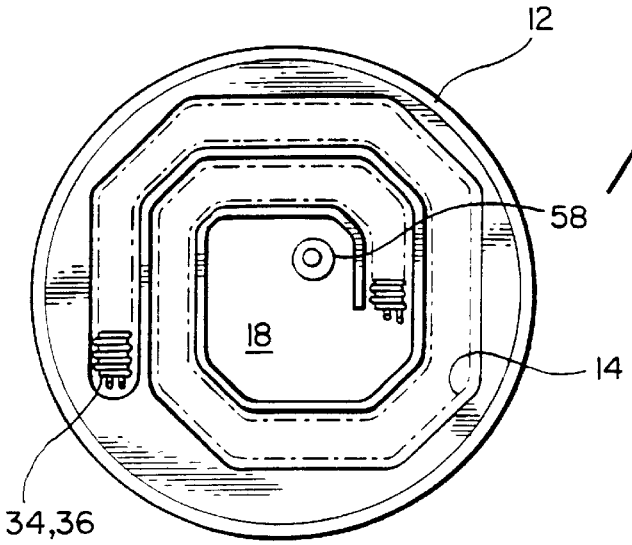
FIGS. 2, 3 and 4 are plan views showing different embodiments of the sump channel arrangement according to the present invention.
Figure 3:
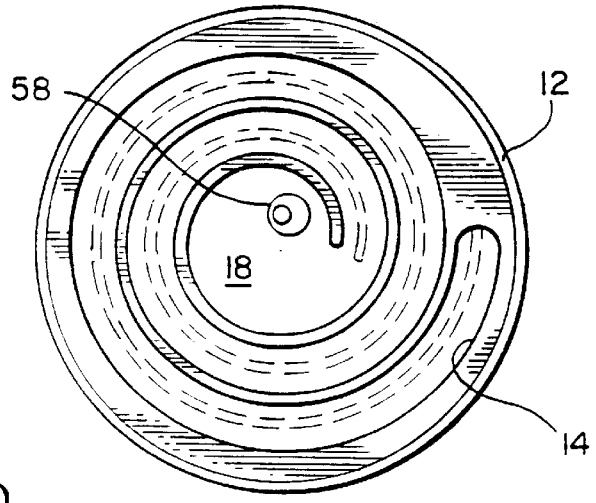
Figure 4:
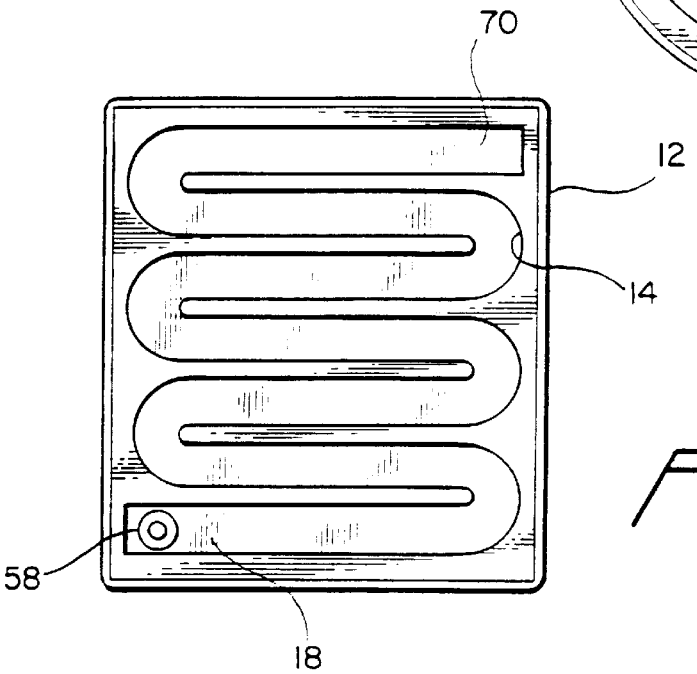

The sump 12, as described above, contains one or more continuous serpentine channels 14 that may extend continuously within the sump in the manner illustrated in FIG. 2, or alternatively, as shown in FIGS. 3 and 4. In FIG. 3, a pair of channels 14 is schematically shown by the dotted lines. If desired, the pump intake region 18 of the sump may be located at a lower level than the region where water flows into the channel 14, which typically is located adjacent the lower edges of the fill medium 44.

In the embodiments illustrated in FIGS. 2 and 3, for example, the evaporative fill medium 44 may be distributed around the periphery of the sump 12 as illustrated in FIG. 1, whereas in the embodiment shown in FIG. 4, the water flowing down through the fill medium 44 (which could be arranged in any suitable configuration) may be channeled to the inlet end 70 of channel 14.

Figure 5:
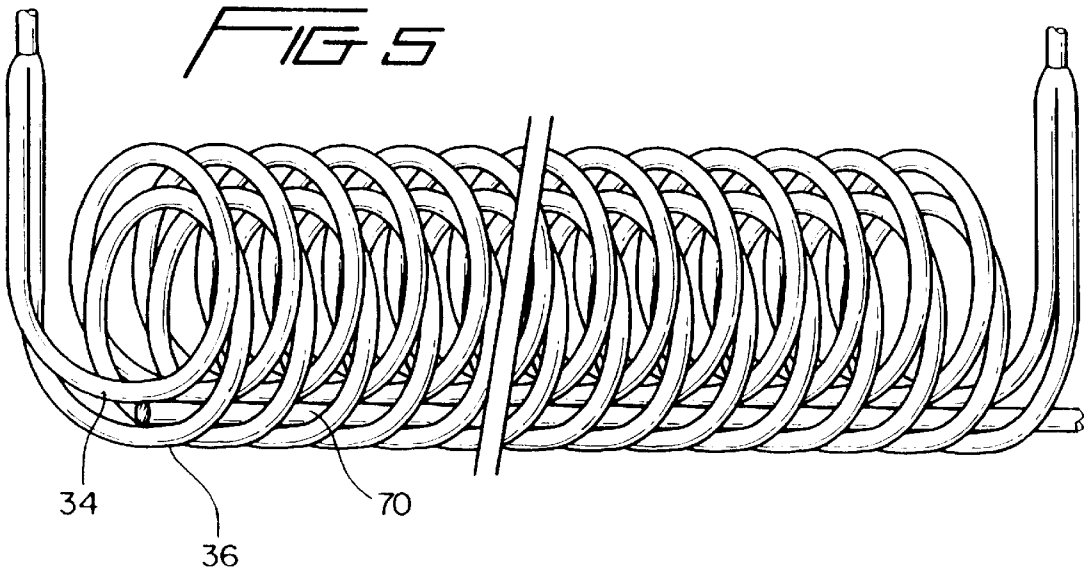
FIGS. 5 and 6 are perspective views showing preferred embodiments of intertwined refrigerant heat exchange coils constructed in accordance with the invention.
Figure 6:
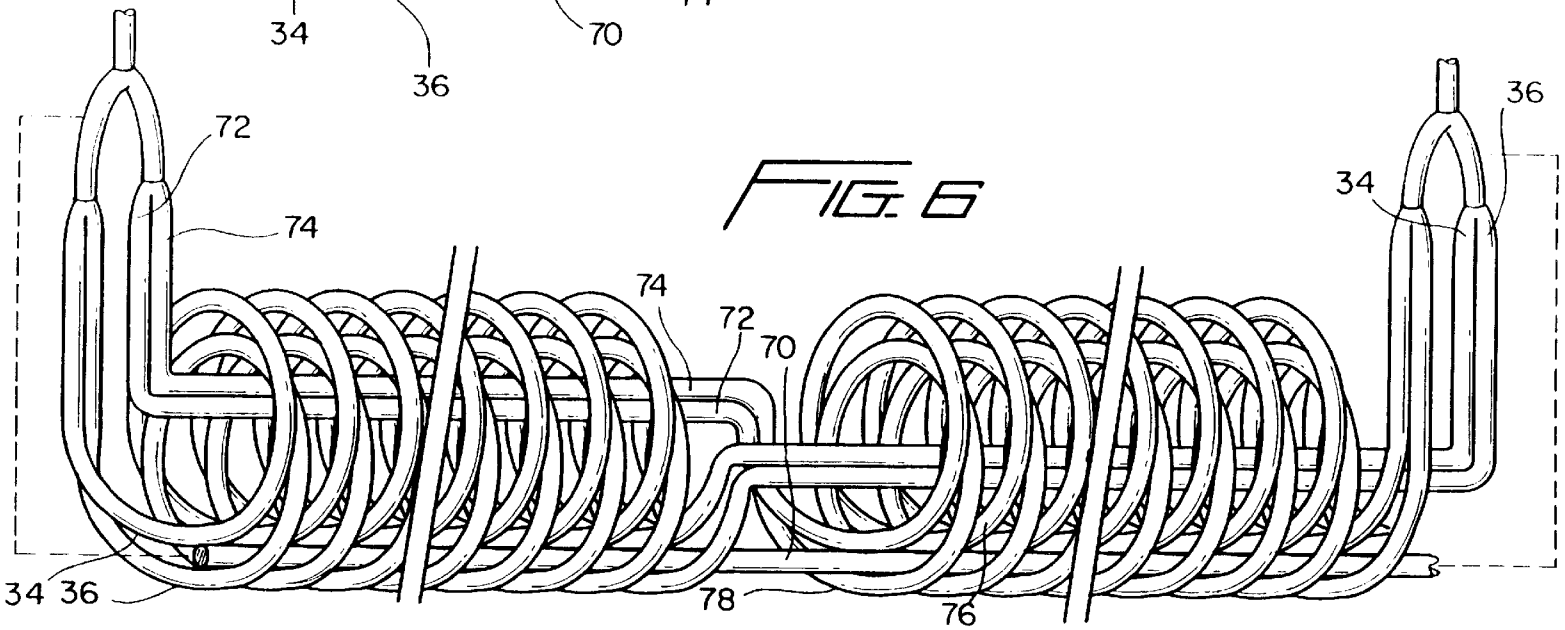

A unique feature of this invention is provided by the intertwined heat exchange tubes 34, 36 forming an elongated condenser coil, two alternate examples of which are illustrated in FIGS. 5 and 6. Tubes 34, 36 comprise heat exchange medium containing tubes (e.g. hot compressed gas or condensed refrigerant) each of which are bent around a coiling axis extending along the length of the condenser in a longitudinal direction to provide spiralled longitudinally disposed upright coil segments, with the coil segments of each tube being further disposed in an intertwined (or interlocked) arrangement with the coiling axes of each tube 34, 36 being offset laterally from the other along the lengths of the coil segments. The offset relationship between the intertwined coil segments is maintained by a spacer element 70 which may take any desired form, but preferably comprises a length of tubing having a size appropriate to maintain an offset relationship between the coiling axes of coils 34, 36. If desired, the spacer element 70 could be an extension of one or more of the tubes 34, 36 to increase the heat exchange surface.

The intertwined relationship between the coils formed by tube 34, 36 is obtained simply by winding the pair of adjacent tubes 34, 36 in spiral fashion while parallel and adjacent each other about a common coiling axis, for example, around a bending mandrel, and then separating the conduits laterally from each other a suitable distance to maintain an offset relationship between their now displaced respective coiling axes, with the coil segments intertwined.

In accordance with FIG. 5, tubes 34, 36 are formed of two lengths of tubular conduit made from, for example, refrigeration quality copper that are joined together at each end for communication with common supply and outlet tubes, for example, refrigerant lines 32 and 38 illustrated in FIG. 1. Refrigerant supplied through compressor outlet 32, for example, would thus enter one end of the condenser coil, for example the left end illustrated in FIG. 5, and exit from the opposite end of the condenser coil, for example, the right side of the coil illustrated in FIG. 5.

In an alternate form, multiple coils may be linked in series while minimizing refrigerant pressure drop (and help minimize refrigerant volume) by arranging the coils in the manner shown in FIG. 6. In this embodiment, tubes 34, 36 located towards the left of the coil arrangement shown in FIG. 6 would be formed in the manner shown in FIG. 5, while a secondary pair of tubes 72, 74 also communicating with a common inlet conduit as lines 34, 36 is located along the interior length of the tubes 34, 36 and then wrapped into a pair of coils 76, 78, respectively, in series with tubes 34, 36. Thus, the secondary set of coils 76, 78 can be formed closely adjacent the first set of tubes 34, 36 without using tubing lengths that promote refrigerant pressure drop and volume.

Any number of coil sets in series can be formed in this manner so as to reduce total tubing length. The placement of the spacer element 70 in the coil shown in FIG. 6 illustrates a typical placement of a spacer element between the tube pairs. However, other spacer arrangements can be envisioned that will maintain the offset relationship between the intertwined tubes 34, 36 and 76, 78. For example, the spacer element 70 could comprise a portion of the refrigerant tubing that is charged with refrigerant supplied from compressor 28, if desired, for increased heat transfer, as shown in FIG. 6.

The condenser coil segments are laid lengthwise along the channel 14 in the sump 12 so that the coils are submerged or in contact with water flowing from the filter medium 44 towards the pump intake region 18 of the sump 12. The intertwined and offset relationship of the coiled tubes 34, 36 (and 76, 78, if a plurality of coils is provided) creates a turbulence in the flowing stream of water directed along channel 14 towards the pump intake port 58. This turbulence creates a high degree of heat exchange between the water and the condenser coils while the intertwined relationship of the coils provides a concentrated quantity of hot refrigerant within the confines of the channels 14 and a large heat exchange surface in contact with the water. The coiled tubes 34, 36 disposed in flowing water that is perturbed by the offset intertwined coils reduce boundary layer effect heat transfer blockage or resistance that might otherwise occur if a smoothly flowing stream of water was provided in the channels 14. This arrangement has been found to provide a highly efficient heat transfer between the hot refrigerant containing coiled tubes 34, 36 and the cooled water flowing from the fill medium 44 towards the pump intake 18 during operation of the refrigeration system. The channel 14 preferably is slightly larger than the diametric dimension of the offset coils so that the water flowing in the channel does not bypass the outer sides of the coils to any great extent.

Preferably, a counterflow arrangement is utilized whereby the hot refrigerant exiting compressor 28 is supplied to the ends of the tubes 34, 36 closest to the pump intake region 18 and is discharged from the tubes 34, 36 at the end thereof closest the region where cool water from the evaporative medium 44 flows into the channel 14. The discharge from the tubes 34, 36, as noted previously, is supplied to the expansion device/evaporator 40 to be utilized in a cooling heat exchange system. This counterflow has been found to enhance efficiency of the system and ensures maximum heat extraction from the hot condensing refrigerant prior to the supply of the condensed refrigerant to the evaporator system 40. The flow of water in the channel 14, of course, becomes progressively warmer as the water flows from bottom of the evaporative fill medium 44 towards the pump intake region 18 of the sump 12. However, in accordance with well-known principles, the water is cooled by flowing downwardly through the evaporative medium 44 while ambient air is circulated through the filter medium by means of fan 52.

If desired, a single conduit with upright tubular coil segments can be laid in the channel 14. This will disturb the flowing water stream for effective heat transfer, but with less turbulence than the dual tube, offset coil segments. Also, it will be noted that more than two tubes 34, 36 can be formed into the offset, intertwined coils to further increase the heat transfer surface provided by the condenser coils and to still further agitate the flowing water.

The sump 12 is provided with a raised section 80 that is elevated above the evaporative fill supporting lip 16 and includes appropriate access apertures 82 extending therethrough that permit the passage of electrical supply lines 84 to compressor 28 and pump 56, as well as any other electrical or refrigeration lines that must enter or exit the interior space within the fill medium 44. For example, the electrical supply lines 84 may extend from a connector panel 86 that may be mounted exteriorly of the evaporative medium 44 on a panel support platform 88 that may be integrally formed with the sump 12 or assembled to the sump structure by an appropriate panel and fastener arrangement. The raised section 80 with apertures 82 avoids the need to provide a water sealing arrangement to prevent leakage of water through the apertures 82, since the apertures are raised above the lower edged of the evaporative medium 44. Water simply flows around the raised lip 80 and never enters the apertures 82. Of course, seals may be used if desired to prevent condensate leakage along cold refrigerant lines.

If desired, the connector panel 86 may be located interiorly of the evaporative medium 44 as shown in phantom lines in FIG. 1. When the control panel is located interiorly of the enclosure formed by the evaporative medium, the apertures 82 do not need to be sealed or otherwise plugged against leakage of circulating cooling water for the reasons outlined above. When the connector panel 86 is so located within the evaporative medium 44, it will be typically mounted on the support platform 24 by a suitable structural connection with the platform.

The platform 24 located centrally within the evaporative medium 44 is raised above the water substantially and remains relatively free of moisture during operation of the refrigerating system. The pump 56 is typically mounted on the underside of the panel 24 by an appropriate connector or bracket which thus enables the support 24 to provide multiple functions, including supporting the compressor 28, supporting a connector panel 86 and supporting a pump 56, all above the sump 12. In addition, the platform 24 may serve to provide a water shield for the upper side of the pump 56 if needed.

A float 90 is provided for actuating a water valve directly or through a microswitch (not shown) to maintain an appropriate level of water in the sump 12. The water valve, of course, is connected to a water supply (not shown). Preferably, the water level in sump 12 at intake region 18 is maintained at constant level during operation of the pump 56.

The channel 14 may be sloped or may be flat along the length of the channel or both, for example, becoming steeper as the pump intake region 18 is approached so as to match the required level and flow rate for the water and to enhance heat exchange between the water and the tubes 34, 36 as the hotter end of the condenser coil is approached.

An appropriate drain plug 92 can be provided exteriorly of the sump 12 at a low point of the channel 14 for draining water from the sump. The position of the plug will be selected, of course, to maximize the amount of water that can be conveniently drained from the sump. As a convenience, it will be noted that the arrangement of the exterior connector panel 86 and the raised section 80 in combination with apertures 82 enable passage of electrical lines 84 as well as refrigerant lines, if desired, without requiring disassembly of the filter medium 44 because the various lines can be threaded around the bottom of the evaporative medium 44 as illustrated in FIG. 1.

If desired, the evaporative medium 44 may be vertically divided to provide access to the interior of the medium 44 without the need to remove the medium from the sump 12. Of course, the cover 48 also can be readily removed to provide access to the interior of the medium 44 for servicing the refrigeration system, etc. Also, as shown at 94 in hidden lines (FIG. 1) fill material 44 is provided with a control panel box receiving aperture 93 that receives a control or access panel box 94 above the sump 12. Appropriate channels in the box 94 diverts water around the box 94 for eventual draining into channel 14. Appropriate electrical and/or refrigerant lines may be connected to the interior of the enclosure formed by the fill material 44 through the rear of the box 94.

The connector panel 86 may provide simple electrical connections or may provide exterior access for refrigeration servicing (access to refrigeration pressure ports, etc.) and may also include refrigeration control elements, if desired.

It will be apparent to those skilled in the art that various other embodiments of the invention can be created without departing from the spirit and scope of the invention, which is defined in the claims that follow.

What is claimed is:

1. A heat exchanger for use in a refrigeration system comprising:

a channel having upright sidewalls for directing a flow of liquid heat exchange medium along the channel;

an elongate coil arrangement extending at least within a lower area of the channel and substantially spanning the channel sidewalls, the coil arrangement comprising a plurality of tubes each generally helically bent around a coiling axis extending along the length of the coil arrangement so as to provide spiralled longitudinally spaced upright coil segments, the coil segments of said tubes being disposed in an intertwined arrangement with the coiling axes of said tubes being offset from each other along the length of said coil arrangement, whereby flow of heat exchange medium within the channel flows through the upright coils parallel to the coil length.

2. A heat exchanger as claimed in claim 1, including a coil separator between the tube segments for maintaining the coiling axes of said tubes offset from each other.

3. A heat exchanger as claimed in claim 2, wherein the coil separator is a tube communicating with at least one of said plurality of tubes.

* * * * *